US007644450B2

(12) United States Patent
Lapossy

(10) Patent No.: US 7,644,450 B2
(45) Date of Patent: Jan. 12, 2010

(54) TOILET VENTILATION SYSTEM

(76) Inventor: Kenneth A. Lapossy, 18039 Falling Leaves Rd., Strongsville, OH (US) 44136

( * ) Notice: Subject to any disclaimer, the term of this patent is extended or adjusted under 35 U.S.C. 154(b) by 646 days.

(21) Appl. No.: 11/152,134

(22) Filed: Jun. 13, 2005

(65) Prior Publication Data

US 2005/0273917 A1 Dec. 15, 2005

Related U.S. Application Data

(60) Provisional application No. 60/579,011, filed on Jun. 12, 2004.

(51) Int. Cl.
*E03D 9/052* (2006.01)

(52) U.S. Cl. ..... 4/213; 4/216

(58) Field of Classification Search ..... 4/213, 4/216

See application file for complete search history.

(56) References Cited

U.S. PATENT DOCUMENTS

| | | | | |
|---|---|---|---|---|
| 136,105 | A | 2/1873 | Smith | |
| 955,518 | A | 4/1910 | Lauphear | |
| 1,563,691 | A | 12/1925 | De Cola | |
| 2,329,221 | A * | 9/1943 | Sanford | 4/213 |
| 3,735,429 | A | 5/1973 | Bondonio | |
| 3,805,304 | A | 4/1974 | Ikehata | |
| 3,939,506 | A | 2/1976 | Pearson | |
| 3,942,200 | A | 3/1976 | Pearson | |
| 4,103,370 | A | 8/1978 | Arnold | |
| 4,133,060 | A | 1/1979 | Webb | |
| 4,168,553 | A | 9/1979 | Studer | |
| 4,800,596 | A | 1/1989 | Menge | |
| 5,029,346 | A | 7/1991 | Fernald, Sr. | |
| 5,255,395 | A | 10/1993 | Millette | |
| 5,321,856 | A | 6/1994 | Gatesi | |
| 5,351,344 | A | 10/1994 | Phillips | |
| 5,539,938 | A | 7/1996 | Tubbs | |
| 5,570,477 | A | 11/1996 | Rodriguez | |
| 6,073,275 | A | 6/2000 | Klopocinski | |
| 6,237,163 | B1 | 5/2001 | Guzzo et al. | |
| 6,295,656 | B1 | 10/2001 | Tillen | |

* cited by examiner

*Primary Examiner*—Robert M Fetsuga
(74) *Attorney, Agent, or Firm*—D.A. Stauffer Patent Services

(57) ABSTRACT

A premium ventilated toilet having an automated toilet ventilation system for removing noxious fumes from a bowl area of the toilet is disclosed. The ventilation system is mostly built-in to the toilet (e.g., ventilation ducts, and sensors) so that it is unobtrusive and attractive looking, however the active parts (e.g., a blower unit containing a blower impeller, a backflow shutoff valve, and electronic control circuitry) are contained in an simple housing that is unobtrusively and removably attached to the surface (preferably on the side) of the toilet base for simplified installation, maintenance, and replacement as needed. Automated operation is enabled by a non-contact occupancy (proximity) sensor and a flush sensor, both preferably built into a flush handle of the toilet. Detection of occupancy causes the ventilation system to operate and flushing turns it off.

10 Claims, 5 Drawing Sheets

TOILET VENTILATION SYSTEM

CROSS-REFERENCE TO RELATED APPLICATIONS

This application claims the benefit of U.S. Provisional Patent Application No. 60/579,011, filed Jun. 12, 2004 by Kenneth A. Lapossy, and which is incorporated in its entirety by reference herein.

TECHNICAL FIELD OF THE INVENTION

The present invention relates to water closets (e.g., lavatory), more particularly to those having ventilation for exhaust of noxious fumes, and most particularly wherein the ventilation means are physically associated with a flush toilet.

BACKGROUND OF THE INVENTION

It has long been desirable to ventilate noxious fumes from toilet enclosures (witness the half-moon cutout in outhouse doors). It has become even more desirable since the advent of indoor plumbing, as evidenced by U.S. Pat. No. 136,105 (Smith; 1873) which discloses an exhaust flue connected at an upward angle to the bottom of a toilet bowl, before the trap.

Typically, the problem is resolved by providing a ventilation fan that exhausts air from the toilet enclosure, but it is not always convenient or even possible to vent the exhausted air to the outside of a building. A less common alternative is to cause the fumes to be passed into the sewage outlet of a toilet beyond a fume trap (typically a water filled drain trap). According to typical building codes and common practice the sewage outlet leads directly to a sewer stack that is vented to the outside.

A relatively simple way to implement this kind of ventilation is by using a retrofittable device such as is disclosed in U.S. Pat. No. 5,570,477 (Rodriguez; 1996) wherein a portable ventilator draws air from the toilet bowl and exhausts it via a tube that extends through the water trap and into the sewer pipe.

Additional work is required (e.g., replacing the floor flange) in order to install a retrofit device as disclosed in U.S. Pat. No. 5,351,344 (Phillips; 1994) wherein an evacuation system can be retrofitted on a standard water closet (see FIGS. 1, 2, 4). A wet/dry vacuum bypass motor pulls air (or overflow fluid) from under the toilet seat and exhausts into a modified closet ring (37) (floor flange) having a down-angled exhaust outlet (42). A pressure switch mounts under the toilet seat for automatic operation limited by a timer. A manual override switch is also provided. The system plugs into an AC power wall outlet. U.S. Pat. No. 6,295,656 (Tillen; 2001) discloses a retrofittable system with an upper insert (24) mountable between the tank and top of the bowl, and a lower insert (30) mountable between the bowl and the floor for communicating with the sewer pipe opening. A fan (26) between the inserts draws gases in through the bowl water spray openings under the rim. A backflow valve flap (82) is used to prevent backflow. The fan can be operated by water, a hand-cranked spring drive, or a battery-operated electric motor. Manual activation of the fan is by means of a push button switch (98, see FIG. 13) that is incorporated into the tank flush handle, and the fan is deactivated by flushing.

Other ventilation systems are less visible due to being built into a toilet, thereby requiring replacement of the toilet with a new toilet having a built-in ventilation system. U.S. Pat. No. 4,800,596 (Menge; 1989) discloses a built-in system drawing gas from the bowl through passages into the water storage tank, through a liquid seal, a vacuum blower, and out into the sewer pipe. The blower is operated by a float switch in the tank. A major concern of this patent appears to be the liquid seal for preventing backflow of sewer gases. U.S. Pat. No. 4,103,370 (Arnold; 1978) discloses a toilet with a built-in system including an intake manifold interposed between the seat and top periphery of the bowl. A suction blower is mounted inside the tank and blows air out through a one way, rubber flap-type check valve (107, FIGS. 10-14) and a deflector (104*c*) into the discharge duct (105) after the trap, and leading to the sewer pipe. It is automated with a pressure switch under the seat and an optional pressure pad on the floor. A timer continues running the blower for a predetermined time after a user leaves. U.S. Pat. No. 6,073,275 (Klopocinski; 2000) discloses a built-in system that draws gases from the bowl, through a fan (64), an odor extraction trap and valve assembly (66), and vents through a downward angled nozzle (53) into the sewer pipe flange shared by the toilet outlet (50). It uses the trap 66 instead of an outlet valve to prevent backflow. U.S. Pat. No. 3,805,304 (Ikehata; 1974) discloses a built-in system providing a separate exhaust channel (7) under the bowl lip, a fan blade (15) in a chamber (11) built-in to the toilet, the fan being driven by an external motor (13), and an exit passage (16) from the chamber into the sewer drain. There does not appear to be any separate backflow prevention devices. The fan is controlled by a floor mounted pressure switch (17).

It is an object of the present invention to provide a high quality, premium toilet with a toilet ventilation system that automatically operates to remove odors from the toilet bowl area in a direct and efficient manner. It is an object to make the ventilation system mostly built in so that it is relatively unobtrusive in appearance. It is an object to removably attach the active parts unobtrusively on the exterior of the toilet for simplified installation, maintenance, and replacement as needed. It is an object to automatically prevent backflow of sewer gases and/or sewage through the toilet ventilation system. It is an object to enable normal toilet use when the active parts are not attached to the toilet.

BRIEF SUMMARY OF THE INVENTION

According to the invention a ventilated toilet for exhausting fumes from a bowl area of the toilet to a sewage stack vent associated with the toilet comprises: a built-in vent exhaust duct extending upward from a bowl vent hole and then downward to an exhaust duct outlet hole; a built-in vent exit duct extending downward from an exit duct opening to a toilet drain duct; a blower unit removably attached to an external surface of the ventilated toilet, and communicating with the exhaust duct outlet hole and the exit duct opening, wherein the blower unit comprises: a housing containing a motor/electrical compartment and a separate sealed airway extending from a blower intake hole downward to a blower output hole; a fan impeller in the airway; a motor mounted in the motor/electrical compartment, but sealingly connected to the fan impeller; a backflow shutoff valve comprising a stopper in the airway and an actuator linked for moving the stopper; and a control circuit.

According to the invention the ventilated toilet further comprises a flush detecting sensor electrically connected to the control circuit.

According to the invention the ventilated toilet further comprises a proximity sensor electrically connected to the control circuit. Preferably the proximity sensor is built-in to a flush handle of the ventilated toilet. Also preferably the ventilated toilet further comprises a flush detecting sensor electrically connected to the control circuit wherein the flush detecting sensor is built-in to the flush handle; and the proximity sensor and the flush detecting sensor are connected to the control circuit by a sensor cable that is detachably connected to the blower unit.

According to the invention the ventilated toilet further comprises the blower unit being removably attached to a side surface of a base of the ventilated toilet.

According to the invention the ventilated toilet further comprises the exhaust duct outlet hole exiting through the external surface at a downward angle; wherein the exit duct opening is below the exhaust duct outlet hole and enters through the external surface at a downward angle; the blower output hole has a downward and outward hooking lower mounting finger for hooking over the bottom of the exit duct opening, thereby aligning the blower output hole with the exit duct opening; and the blower intake hole has a vertically adjustable upper mounting finger that hooks upward and outward for adjustably hooking over the top of the exhaust duct outlet hole, thereby aligning the blower intake hole with the exhaust duct outlet hole. Preferably the ventilated toilet further comprises a flat mounting surface around the exhaust duct outlet hole and the exit duct opening.

According to the invention the ventilated toilet further comprises a service cover shaped to sealingly cover the exhaust duct outlet hole and the exit duct opening.

According to the invention the ventilated toilet further comprises an electric actuator for the backflow shutoff valve that is a solenoid built into the motor.

According to the invention the ventilated toilet further comprises a mechanical actuator for the backflow shutoff valve, wherein the actuator comprises: an externally threaded arbor extending from a drive shaft of the motor and contained within a hub of the impeller; a spline on the inside diameter of the impeller hub; a nut-hub extending from a stopper of the backflow shutoff valve; an internal thread in the nut-hub that screwingly mates with the external threads on the arbor; and a spline on the outside diameter of the nut-hub such that the nut-hub spline slidingly but non-rotatingly fits within the spline on the inside diameter of the impeller hub.

According to the invention a toilet ventilation system for exhausting fumes from a bowl area of a toilet to a sewage stack vent associated with the toilet comprises: a vent exhaust duct built-in to the toilet and extending upward from a bowl vent hole and then downward to an exhaust duct outlet hole; a vent exit duct built-in to the toilet and extending downward from an exit duct opening to a toilet drain duct; a blower unit removably attached to an external surface of the toilet, and communicating with the exhaust duct outlet hole and the exit duct opening, wherein the blower unit comprises: a housing containing a motor/electrical compartment and a separate sealed airway extending downward from a blower intake hole to a blower output hole; a fan impeller in the airway; a motor mounted in the motor/electrical compartment, but sealingly connected to the fan impeller; a backflow shutoff valve comprising a stopper in the airway and an actuator linked for moving the stopper; and a control circuit.

According to the invention the toilet ventilation system further comprises a flush detecting sensor electrically connected to the control circuit, and positioned to detect flushing of the toilet.

According to the invention the toilet ventilation system further comprises a proximity sensor electrically connected to the control circuit, and positioned to detect an occupant sitting on a seat of the toilet. Preferably the toilet ventilation system further comprises a flush detecting sensor electrically connected to the control circuit, and positioned to detect flushing of the toilet; wherein: the flush detecting sensor and the proximity sensor are built-in to a flush handle of the ventilated toilet; and the proximity sensor and the flush detecting sensor are connected to the control circuit by a sensor cable that is detachably connected to the blower unit.

According to the invention the toilet ventilation system further comprises a construction wherein: the exhaust duct outlet hole exits through the external surface at a downward angle; the exit duct opening is below the exhaust duct outlet hole and enters through the external surface at a downward angle; the blower output hole has a downward and outward hooking lower mounting finger for hooking over the bottom of the exit duct opening, thereby aligning the blower output hole with the exit duct opening; and the blower intake hole has a vertically adjustable upper mounting finger that hooks upward and outward for adjustably hooking over the top of the exhaust duct outlet hole, thereby aligning the blower intake hole with the exhaust duct outlet hole.

According to the invention the toilet ventilation system further comprises an electric actuator for the backflow shutoff valve that is a solenoid built into the motor.

According to the invention the toilet ventilation system further comprises a mechanical actuator for the backflow shutoff valve, wherein the actuator comprises: an externally threaded arbor extending from a drive shaft of the motor and contained within a hub of the impeller; a spline on the inside diameter of the impeller hub; a nut-hub extending from a stopper of the backflow shutoff valve; an internal thread in the nut-hub that screwingly mates with the external threads on the arbor; and a spline on the outside diameter of the nut-hub such that the nut-hub spline slidingly but non-rotatingly fits within the spline on the inside diameter of the impeller hub.

According to the invention a method for exhausting fumes from a bowl area of a toilet to a sewage stack vent associated with the toilet comprises the steps of: building a vent exhaust duct into the toilet, the duct extending upward from a bowl vent hole then back downward to an exhaust duct outlet hole; building a vent exit duct into the toilet, the duct extending from an exit duct opening located below the exhaust duct outlet hole, downward to a toilet drain duct; removably attaching a blower unit to an external surface of the toilet, such that the blower unit communicates with the exhaust duct outlet hole and the exit duct opening, wherein the blower unit comprises: a housing containing a motor/electrical compartment and a separate airway extending from a blower intake hole downward to a blower output hole; a fan impeller in the airway; a motor mounted in the motor/electrical compartment, but sealingly connected to the fan impeller; a backflow shutoff valve comprising a stopper in the airway and an actuator linked for moving the stopper; and a control circuit; and using the control circuit to initiate a ventilation activity including the steps of: opening the backflow shutoff valve, thereby moving the stopper to open the blower unit airway; and turning on the motor for rotating the fan impeller to draw fumes from the bowl through the vent exhaust duct, out the exhaust duct outlet hole and thereby into the communicating blower unit airway; and to direct the fumes past the open backflow shutoff valve stopper, thereafter to pass out of the blower output hole of the airway and thereby through the communicating exit duct opening into the vent exit duct thereby to pass out through the toilet drain duct into a sewage stack which has the sewage stack vent.

According to the invention the method further comprises the steps of: using a non-contact proximity sensor to trigger the control circuit to initiate the ventilation activity whenever the proximity sensor detects a user that is close enough to sit on a seat of the toilet; and using a flush detecting sensor to trigger the control circuit to halt the ventilation activity when the toilet is flushed, wherein the step of halting the ventilation activity comprises turning off the motor and causing the backflow shutoff valve stopper to close in a way that blocks passage of gaseous, liquid or solid material through the blower unit airway.

Other objects, features and advantages of the invention will become apparent in light of the following description thereof.

BRIEF DESCRIPTION OF THE DRAWINGS

Reference will be made in detail to preferred embodiments of the invention, examples of which are illustrated in the accompanying drawing figures. The figures are intended to be illustrative, not limiting. Although the invention is generally described in the context of these preferred embodiments, it should be understood that it is not intended to limit the spirit and scope of the invention to these particular embodiments.

Certain elements in selected ones of the drawings may be illustrated not-to-scale, for illustrative clarity. The cross-sectional views, if any, presented herein may be in the form of "slices", or "near-sighted" cross-sectional views, omitting certain background lines which would otherwise be visible in a true cross-sectional view, for illustrative clarity.

Elements of the figures can be numbered such that similar (including identical) elements may be referred to with similar numbers in a single drawing. For example, each of a plurality of elements collectively referred to as 199 may be referred to individually as 199*a*, 199*b*, 199*c*, etc. Or, related but modified elements may have the same number but are distinguished by primes. For example, 109, 109', and 109" are three different elements which are similar or related in some way, but have significant modifications, e.g., a tire 109 having a static imbalance versus a different tire 109' of the same design, but having a couple imbalance. Such relationships, if any, between similar elements in the same or different figures will become apparent throughout the specification, including, if applicable, in the claims and abstract.

Figure 1:
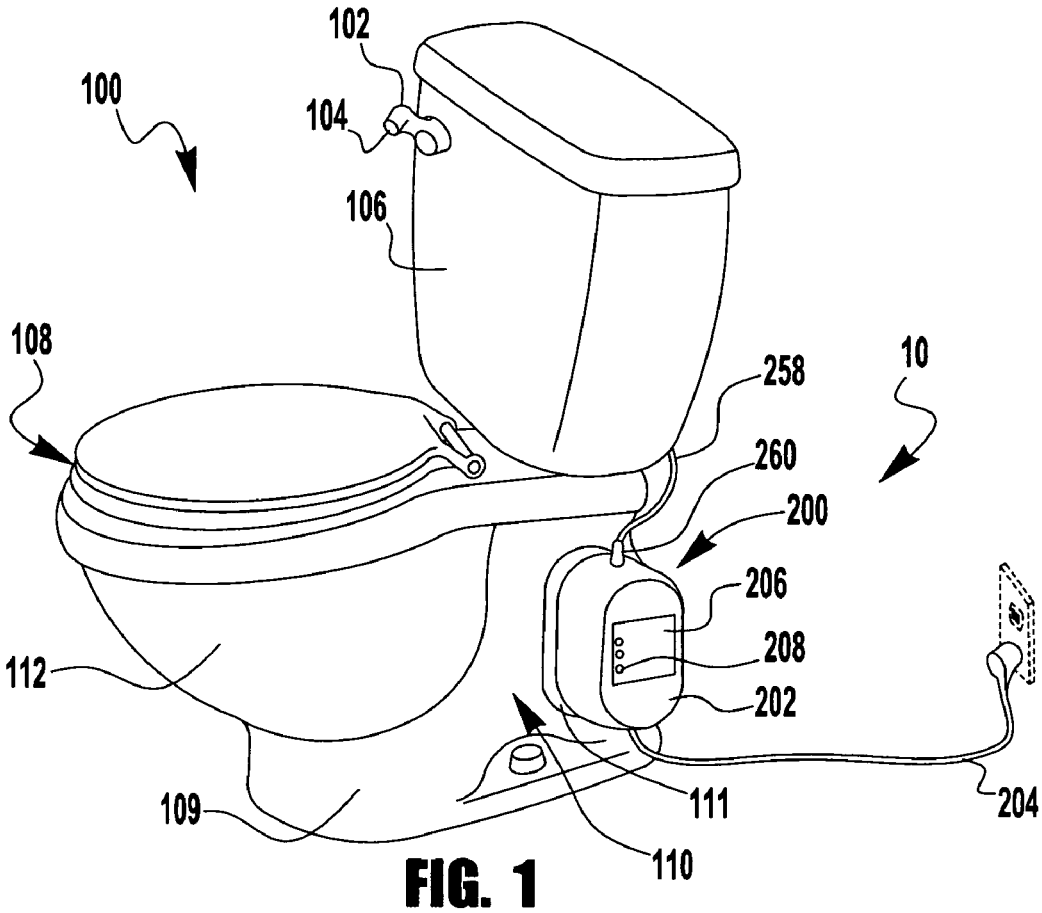
Figure 2:
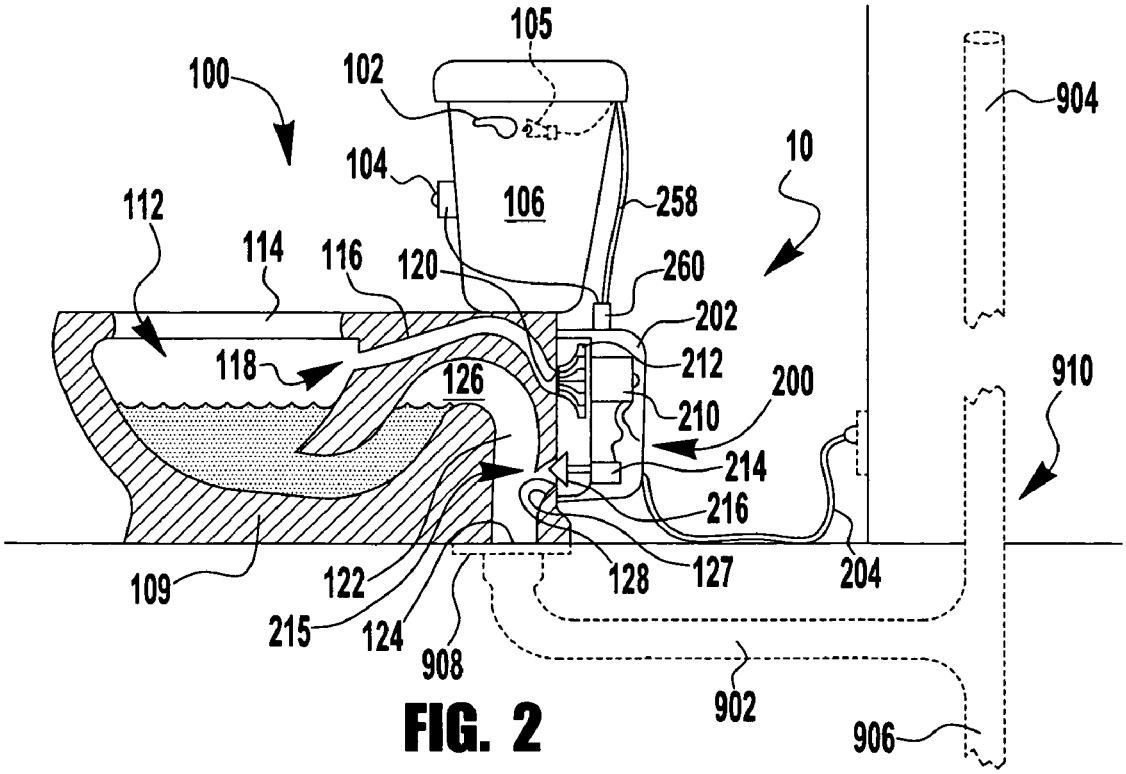
Figure 3B:
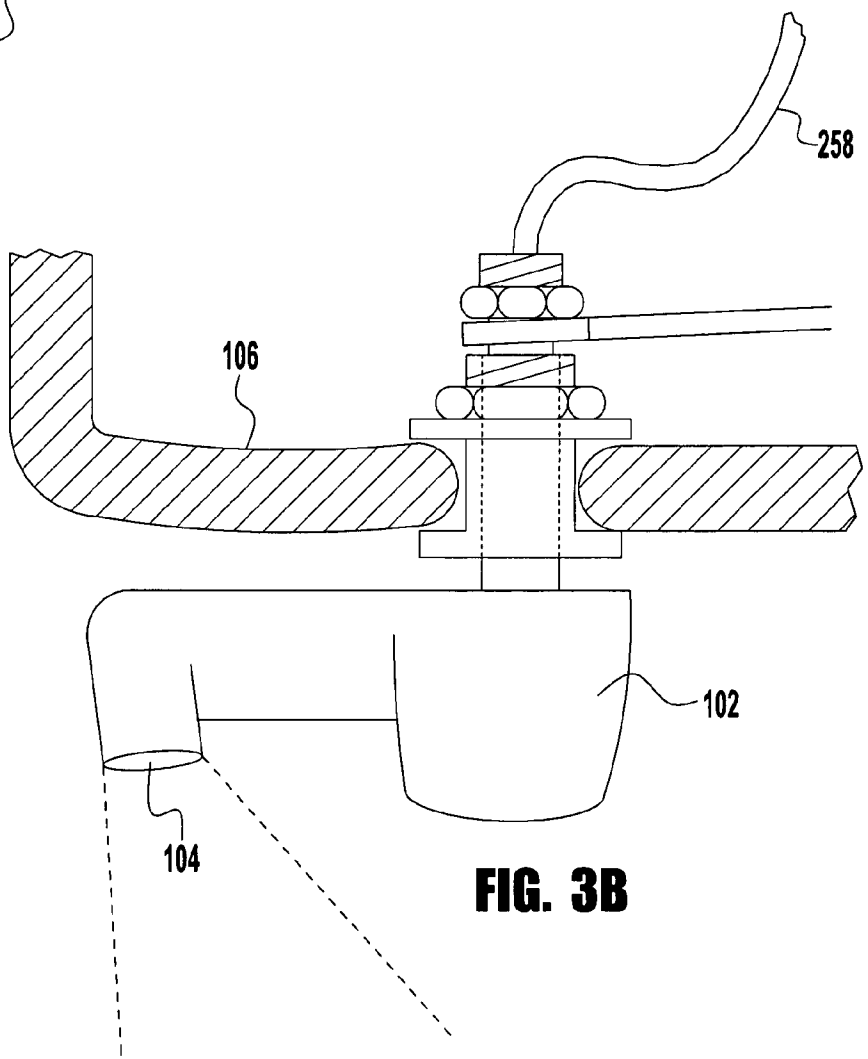
Figure 3A:
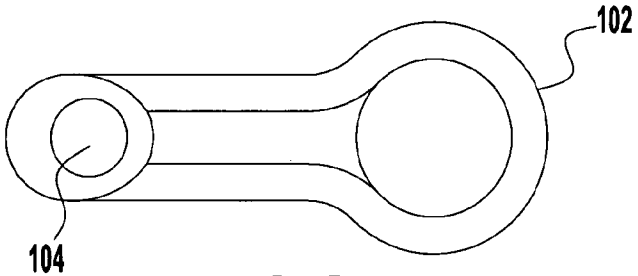
Figure 3C:
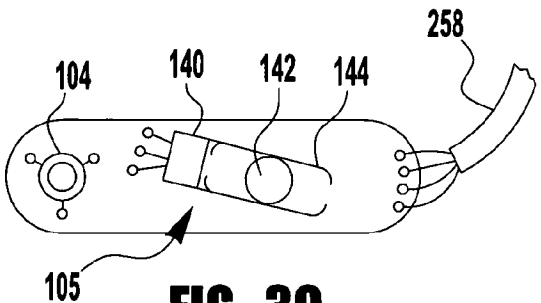
Figure 5:
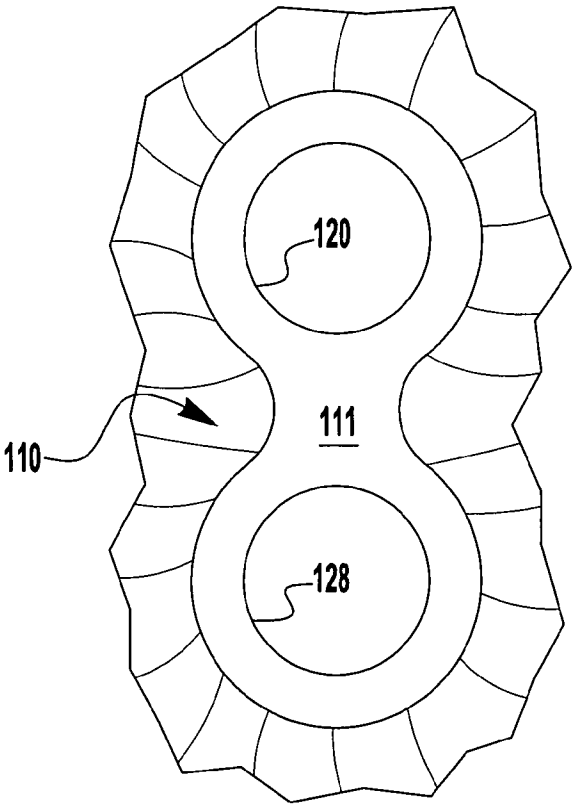
Figure 4:
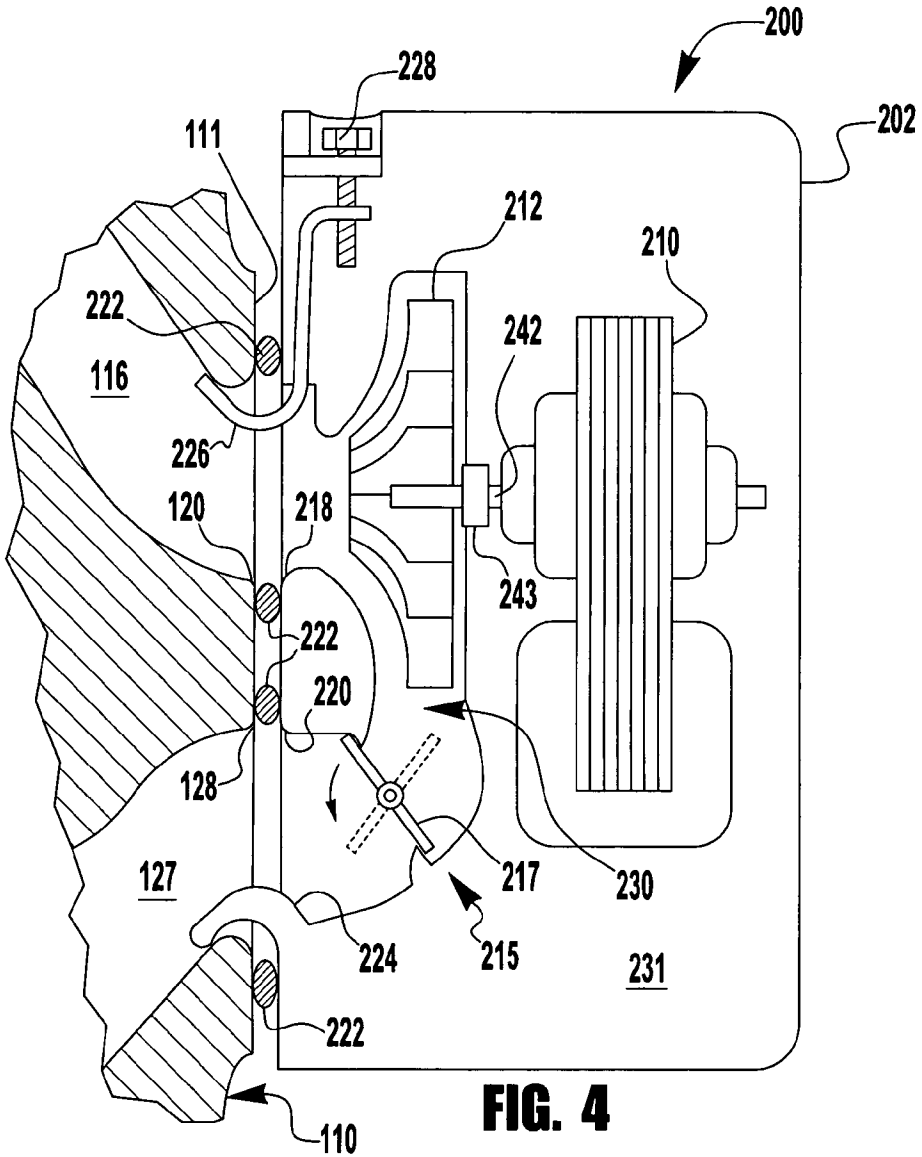
Figure 6:
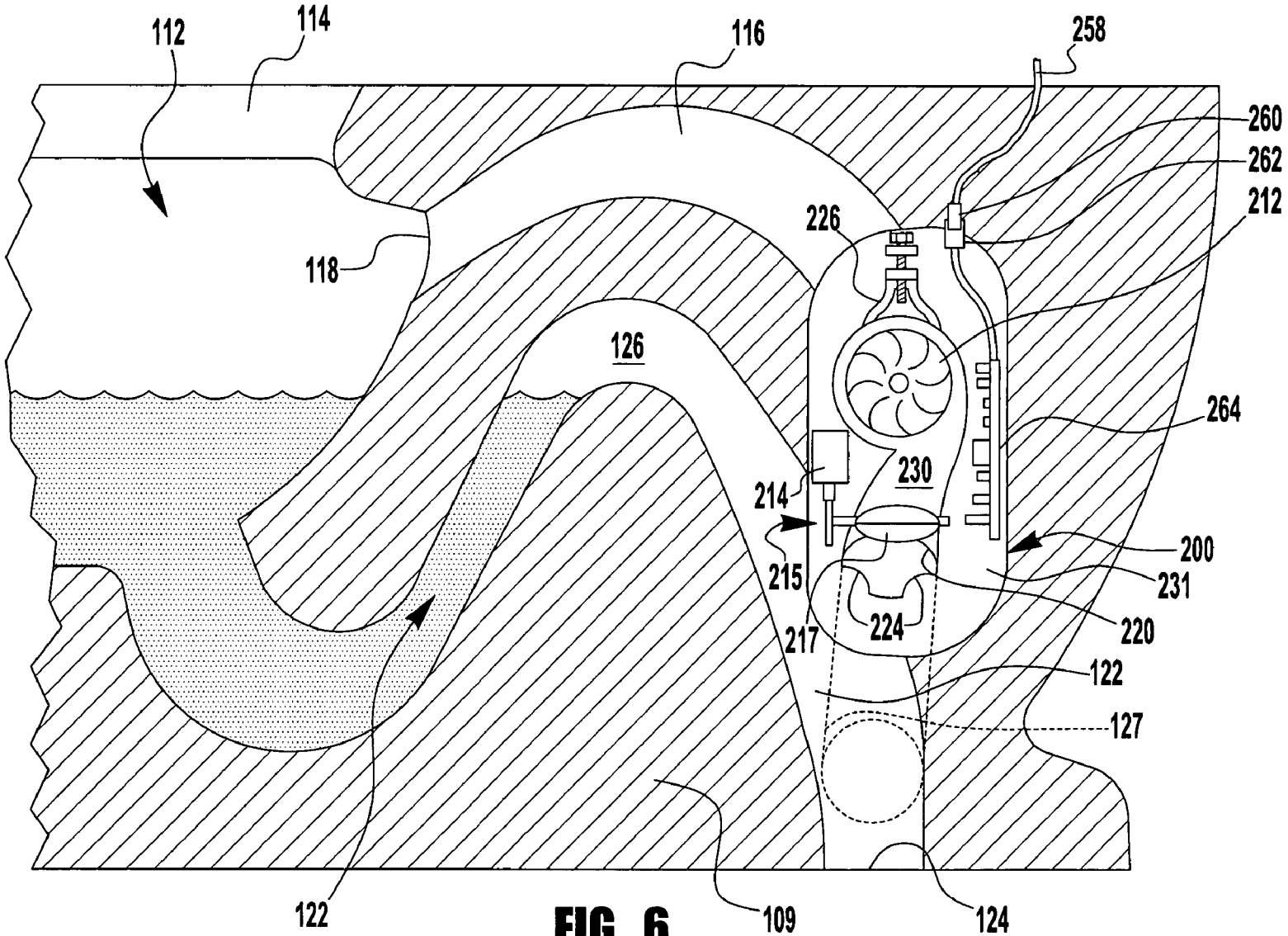
Figure 8B:
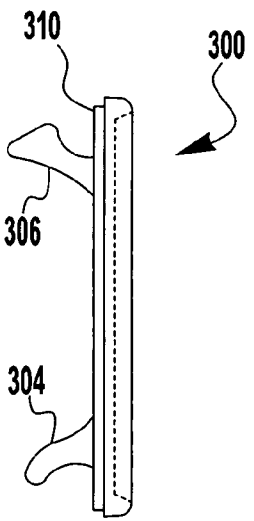
Figure 8A:
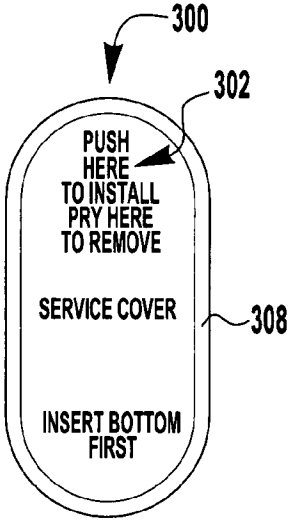
Figure 8C:
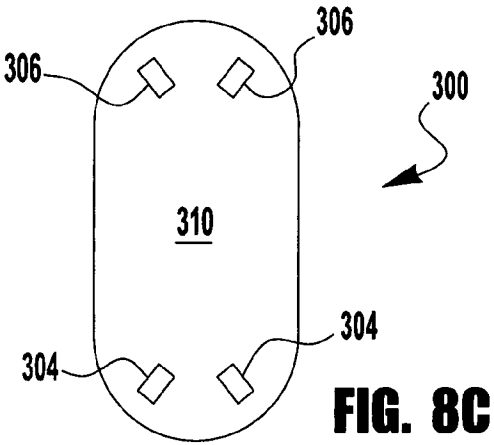
Figure 7:
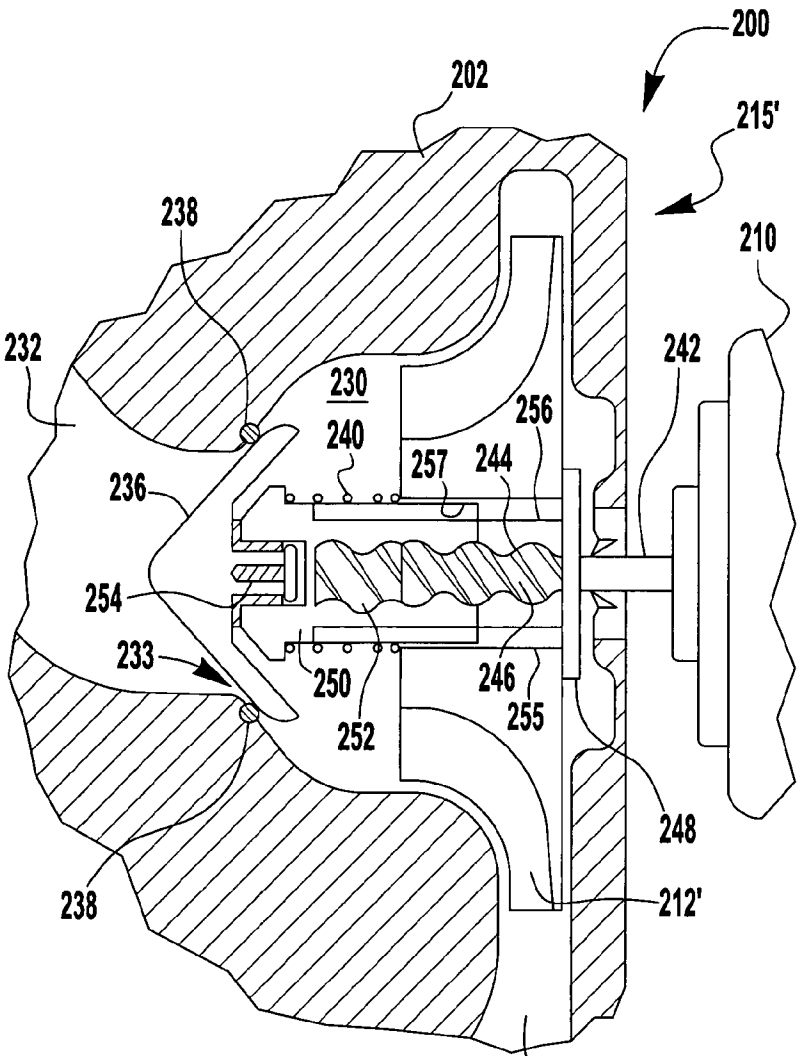

The structure, operation, and advantages of the present preferred embodiment of the invention will become further apparent upon consideration of the following description taken in conjunction with the accompanying drawings, wherein:

FIG. 1 is a perspective view of a ventilated toilet having an automated toilet ventilation system according to the invention;

FIG. 2 is side cross-sectional view of a ventilated toilet having an automated toilet ventilation system according to the invention;

FIG. 3A is a front view of a flush handle for the ventilated toilet of FIG. 1 according to the invention;

FIG. 3B is a top view of the flush handle of FIG. 3A, showing it mounted for use on a tank (partially shown in cross-section) of the ventilated toilet of FIG. 1 according to the invention;

FIG. 3C is a schematic representation of sensors and wiring inside the flush handle of FIG. 3A according to the invention;

FIG. 4 is a side cross-sectional view of a blower unit removably mounted on the side of the ventilated toilet of FIG. 1 according to the invention;

FIG. 5 is a perspective front view of a mounting surface for the blower unit of FIG. 4 according to the invention;

FIG. 6 is a side cross-sectional view of a base of the ventilated toilet of FIG. 1 with a blower unit (cover removed to show inside details) superimposed in front of the toilet base where it is mounted according to the invention;

FIG. 7 is a side cross-sectional view of a portion of a blower unit showing a second embodiment of a backflow valve (cross-section shaded partly omitted for clarity) according to the invention; and FIGS. 8A, 8B, and 8C are outside, side, and inside views, respectively, of a service cover for the ventilated toilet of FIG. 1 according to the invention.

DETAILED DESCRIPTION OF THE INVENTION

The embodiments of the present invention as described herein show a premium ventilated toilet 100 having an automated toilet ventilation system 10 for removing noxious fumes from a bowl area 112 of the toilet 100. The system 10 is mostly built-in to the toilet 100 so that it is unobtrusive and attractive looking, however the active parts (e.g., a blower unit 200 containing a blower impeller 212, a backflow valve 215, and electronics 264) are contained in an simple housing 202 that is unobtrusively and removably attached to a toilet base 109 for simplified installation, maintenance, and replacement as needed.

Referring to FIGS. 1-2, the ventilated toilet 100 is shown in perspective and side cross-section views. Certain parts are omitted or moved in FIG. 2 relative to FIG. 1 for the sake of clarity. Other parts are shown differently in the two. figures according to different embodiments. For example, the blower unit 200 is shown in FIG. 2 as being mounted on the rear of the base 109, but the preferred location is on the side 110 of the base 109 as shown in FIG. 1 (preferred due to easier access for mounting or removing or maintenance).

As is normal for a flush toilet design, the toilet 100 has a water storage tank 106 with a flush handle 102, the tank 106 being mounted above the base 109 that rests on the floor of the enclosed toilet area. A toilet bowl 112 having a rim 114 around the top, is integrally formed with the base 109. A standard toilet seat 108 is hingedly attached on top of the rim 114. A toilet drain duct 122, also integrally formed with the base 109 (i.e., built-in when cast), extends from a lower portion of the bowl 112, up around a water trap 126 and back down to an exit hole 124 that has the usual formation of a protruding nozzle for seating and sealing in a mating floor flange (e.g., 908, not part of the toilet) that is part of the sewage stack 910 in the building. The sewage stack 910 has a toilet branch sewage line (pipe) 902 extending from the floor flange 908 to join with the stack drain line 906. The sewage stack 910 also has a stack vent pipe 904 and this is what allows fumes to be exhausted from the toilet 100 into the sewage stack 910 and out of the building through the vent pipe 904. The water trap 126 prevents sewer gas (fumes in the sewage stack) from flowing back out of a toilet into the enclosed toilet area, therefore an important consideration in any toilet ventilation system is that the ventilation system should also prevent backflow of sewer gas.

The inventive toilet ventilation system 10 includes components that are hidden by being built-in to the ventilated toilet 100 (e.g., a vent exhaust duct 116, and an occupancy sensor 104); and also includes components that are unobtrusively mounted on the toilet exterior (e.g., a blower unit 200). These and other components are described in detail hereinbelow. A preferred embodiment is disclosed, but is not to be considered limiting, especially in terms of obviously variable specifications such as dimensions and materials, which are disclosed simply as non-limiting examples.

Ducting Details

Referring to FIGS. 1-7 air passages (ventilation ducts) are cast into the toilet bowl (built-in). Starting at the ventilation inlet side, one or more bowl vent hole(s) 118, e.g., a series of five 1 inch diameter holes in a row, are located high up at the back of the bowl 112 but under the rim 114. These will join together and combine into one vent exhaust duct 116 of about 2 inches in diameter and run upward so that any water entering the exhaust duct 116 will drain back toward the bowl 112. After reaching the highest possible and practical point within the toilet bowl casting the exhaust duct 116 will run downward to an exhaust duct outlet hole 120, which aligns with an intake hole 218 of the blower unit 200, entering an airway 230 of the blower unit 200 at a somewhat downward angle, again to allow any water in the duct 116 to drain. There should be no low cavities or pockets to trap water or any debris in the ductwork such as the exhaust duct 116.

A vent exit duct 127 extends from an exit duct opening 128 at the blower unit 200 to the toilet drain duct 122 near the bottom of the toilet base 109, and will generally be fairly short so as not to interfere with the flushing action of the toilet, perhaps 1 inch long more or less. It is also the same 2 inches in diameter, runs downward, and is free of water trapping pockets. The exit duct opening 128 is aligned with a blower output hole 220 which is the exit of the blower unit airway 230.

Blower Mounting

Another consideration regarding the bowl casting is the mounting of the blower unit 200. Referring particularly to FIGS. 4-6, a flat surface 111 is provided around the exhaust duct outlet hole 120 and the exit duct opening 128 for the blower unit 200 to seal and rest against. Exemplary dimensions are as follows: the two duct openings 120, 128 are 2 inches in diameter and spaced vertically a distance of 4 inches, center to center. The flat surface 111 around each opening will be at least ½ inch wide and in the same plane. Alternately, there can be one flat surface 111 at the duct openings as described above, forming an oblong shape while maintaining at least ½ inch of flat surface around each of the openings 120, 128. For example, the flat surface 111 is approximately the same overall shape and dimensions as the blower unit 200, as shown in FIG. 1.

The angle that the air ducts 116, 127 intersect the plane of the mounting surface 111 should be about 45 degrees. This will form a lip at the top of the upper opening (exhaust duct outlet hole 120) and at the bottom of the lower opening (exit duct opening 128). Mounting fingers on the blower unit 200 will engage these lips to secure the blower unit 200 to the side of the toilet bowl 110 by hooking behind the lips and pulling the blower unit 200 snugly against the mounting surface 111. The interface of the blower unit 200 to the toilet bowl side 110 is sealed with a fairly soft, closed cell neoprene or similar material gasket 222 (for example, the gasket 222 is optionally two O-rings as shown). The gasket 222 will encircle both duct openings 120, 128, is at least about ⅜ inch wide and about ⅛ inch thick for conforming to surface irregularities.

For securing to the lower exit duct opening 128, two lower mounting fingers 224 molded as part of the base of the blower housing 202 hook behind the lip at the bottom of the exit duct opening 128. The lower fingers 224 are positioned at roughly the 5 and 7 o'clock positions around the exit duct opening 128, or somewhat wider, to aid in centering the blower unit 200 side to side when mounting. The space between these two lower mounting fingers 224, being at the lowest point in the blower housing 202, will allow unrestricted drainage.

An upper mounting fork 226 is vertically movable to enable mounting and removing the blower unit 200. The fork 226 has two fingers that are part of a stainless steel metal stamping resembling a letter "Y" inverted. The forked lower end is formed so both fingers 226 hook onto the upper edge of the exhaust duct outlet hole 120. This forked hook 226 acts, as the two bottom hooks 224 do, to center the blower unit 200 side to side by engaging the round duct opening 120 at the 1 and 11 o'clock positions. A shank mid-portion of the forked fingers 226 fits and can slide in a channel in the blower housing 202. A seal is formed of closed cell neoprene, or similar material, around the shank at a point where it passes under the duct gasket at the 12 o'clock position on the upper duct opening 120. This seal sits in a recessed area formed in the base of the blower housing 202. The top end of the forked fingers 226 is formed at a right angle away from the toilet bowl, going a short distance into the blower unit 200. A tapped hole in the top end works with a screw 228 held in the blower housing 202 to move the forked fingers 226 up or down to engage with the lip in the exhaust duct outlet hole 120. Tightening the screw 228 will both pull the blower unit 200 downward and also draw the blower unit 200 tightly against the mounting surface 111 as the fingers 224, 226 grip the angled openings 120, 128.

This mounting method keeps the bowl 112 casting somewhat simple as no other mounting holes are needed for screws and the like. The dimensional tolerance of the bowl casting as it pertains to interfacing with the blower unit 200 should be as good as possible and practical for work in that trade. Normal variations in flatness of the mounting surface 111 will be allowed for by a conforming seal of the gasket 222 between the two surfaces. The distance between, and size of, the two duct openings 120, 128 is most important as it affects the engagement of the mounting fingers 224, 226. However, the blower unit 200 design includes the adjustable upper forked finger 226 to accomplish removably mounting it.

Backflow Valve Details (First Embodiment)

The blower housing 202 contains a backflow shutoff valve 215 (backflow valve). Its purpose is to close off the ventilation ducts 116, 127 when the blower 200 is not operating, thereby stopping sewer gases from backing out of the ventilated toilet 100. Therefore, closed is the normal state of the backflow valve 215. A stopper for the backflow valve 215 may be a butterfly 217, a poppet 216, a flapper (not shown), or other related valve mechanisms. A design choice should consider one with enough flow capacity to offer minimum resistance to the airflow in the open position. In a first embodiment, the backflow valve 215 is opened, and held open, by an actuator (e.g., a solenoid) 214 when energized. The closed position is maintained by a spring bias in the solenoid 214 or at some other point in the linkage between the solenoid 214 and stopper 216, but preferably not in the airway 230. Between the airway 230 and a sealed motor/electrical compartment 231 of the blower unit 200 the linkage or shaft must pass through a seal to exclude moisture. The linkage or shaft, stopper 216, 217, and seal must be of materials resistant to moisture and chemical attack as well as having good mechanical wear characteristics. The design could use a shaft seal the same as or similar to one around a shaft 242 of the motor 210 if a rotating design is used. If an axial motion design is used a wiper type of seal or a bellows type boot can be used. Other important considerations in choosing a design are the ability to not trap water or debris, and to have a long operating life.

The solenoid 214 needs to have a long enough travel for opening the backflow valve 215 wide. It must also be strong enough to overcome the possibility of accidental water filling in behind the stopper 216, 217, i.e., a sewer backup. An air damped, or cushioned, action will reduce the noise of operation. The solenoid's coil is to be resin dipped for moisture resistance. As part of the solenoid 214, or linked mechanically, is a set of electrical contacts the purpose of which is to turn on the motor 210. (In a second embodiment, disclosed hereinbelow, the electrical contacts are not needed because the motor 210 and solenoid 214 are combined.) The solenoid 214 has been described as one embodiment of a variety of electro-mechanical actuators 214 that could be used. Other embodiments include, for example, a rotary or a piezoelectric actuator 214.

Backflow Valve Details (Second Embodiment)

Referring in particular to FIG. 7, a second embodiment of the backflow valve 215' is shown built into the blower housing 202 which is shown in a partial cross-sectional view with a housing inlet duct 232 portion of the airway 230 leading into the blower unit 200 from the blower intake hole 218 (not shown), and a housing outlet duct 234 portion of the airway 230 leading out of the blower unit 200 to the blower output hole 220 (not shown). The second embodiment of the backflow valve 215' is simpler than the electromechanical first embodiment backflow valve 215 described hereinabove, and should give equal or better overall performance and be less costly to manufacture.

The basic operation of the second embodiment of the backflow valve 215' is to use rotary torque from the blower motor 210 to obtain linear motion to open a port in the airway 230 (e.g., housing inlet duct 232), allowing air to flow into the modified impeller 212' and thereby be moved through the toilet ventilation system 10. When the motor 210 is deactivated, a return spring 240 supplies energy to close the backflow valve 215' to airflow. Linear motion is obtained by the action of a specialized screw and nut arrangement in a hub 250 of the modified blower impeller 212'. The torque of the motor 210 working against the resistance offered by the impeller 212' causes the screw and nut to pull the nose 236 of the hub 250 (i.e., the nose 236 is the backflow valve stopper) toward the motor 210 and away from the airway 230 (e.g., housing inlet duct 232) while compressing or winding up the spring 240 that will return the stopper 236 to the extended position, sealed against a duct opening 233, thereby blocking the airway 230 (e.g., housing inlet duct 232). Although shown blocking the housing inlet duct 232, it should be apparent that the second embodiment backflow valve 215' could alternatively be implemented to block the housing outlet duct 234.

A description of the main parts of the second embodiment of the backflow valve 215' and their functions follows.

The motor shaft 242 is fitted with an arbor 244 having its length containing a coarse helical thread 246 and a thrust-bearing flange 248 at the end toward the motor 210. The size and length of the arbor 244 is sufficient to accept the motor shaft with a secure fit and have enough range of travel for a nut-hub 250 to travel over. The threads 246 can have any of a variety of profiles (e.g., Vee or rounded) and a fairly steep pitch of about 45 degrees, an angle that will afford the same mechanical advantage to the return spring 240 as the screw thread 246 has in pulling in the nut-hub 250.

The nut-hub 250 has internal threads 252 to engage with the external threads 246 of the motor shaft arbor 244 with a close slip fit so as to screw onto the arbor 244 and compress the return spring 240, and then to allow spring pressure to push the nut-hub 250 back out. The outer diameter of the nut-hub 250 has a splined surface 257 to transfer rotary motion between the impeller 212' and the nut-hub 250 and to allow the nut-hub 250 to slide toward the motor 210 and back again. The fit between these parts must be close enough not to rattle and have rotating parts go out of balance, but still to allow an easy sliding motion. The nose 236 of the nut-hub 250 is shaped to act as a stopper 236 of the backflow valve 215' within the duct opening 233. It should have a rounded or pointed end to aid air flowing over it. To limit wear between the hub nose and its seat in the duct opening it may be necessary to have the nose free to spin on a bearing 254. This will greatly reduce the friction between valve surfaces when the motor 210 de-energizes and the return spring 240 forces the nose 236 of the nut-hub 250 (which is rotating with the impeller 212') into the valve seat (duct opening 233, preferably having a gasket 238, such as an O-ring).

The modified impeller 212' has a hub 255 with a splined inside diameter 256 to mate with the splined outside diameter 257 of the nut-hub 250. As the nut-hub 250 screws onto the arbor 244 and slides into the impeller hub 255 the return spring 240 is compressed. The modified impeller 212' is held in position along the motor shaft 242 axis by the flange 248 on the arbor 244. The pressure of the return spring 240 holds the impeller 212' against this flange 248.

The return spring 240 is positioned between the nut-hub 250 and the impeller 212'. The return spring 240 may be one spring or more arranged in a balanced pattern around the motor shaft 242 axis and held in position by blind holes in either the nut-hub 250 or the modified impeller 212'. The nut-hub 250 is preferred, as to offer the best containment method and to shield the return spring 240 from damage and contamination. Another arrangement would use one spring around the outside of the nut-hub 250 between a flange near the nose 236 and against the modified impeller 212'. The spring force is used to hold the impeller 212' against the arbor flange 248 and to close the backflow valve 215' by forcing the nose (stopper) 236 of the nut-hub 250 into the seat around the duct opening 233. This force must be less than that obtained by the linear thrust from the arbor screw threads 246. Since load variations will occur with the blower unit 200 a range of operation must be allowed for. The characteristics of the blower performance should be considered carefully for this design. It is preferred that the torque requirements of the blower unit 200 be constant for various air loads (volumes) placed on it.

An alternative arrangement would eliminate the return spring 240 by making the flange 248 part of the impeller hub 255, but the flange 248 would be rotatingly connected to the motor shaft 242 while being trapped between the arbor 244 and a ridge on the shaft 242 thereby preventing axial movement of the flange 248 and thus the modified impeller 212'. For this arrangement, starting the motor 210 would rotate the arbor 244 which would pull the nut-hub 250 back into the impeller hub 255 until it was fully retracted, at which point the nut-hub 250 would rotate and also cause the impeller 212' to rotate due to the mating splined surfaces 255, 257. When the motor 210 is stopped, the process reverses as inertia causes the linked impeller 212' and nut hub 250 to continue rotating and unscrewing on the stopped arbor 244 until the stopper 236 lodges against the duct opening 233 (and/or gasket 238) and is held there by friction and by the arbor 244 that is held in place by the stopped motor 210. If necessary, the motor 210 can have a brake on it that prevents the shaft 242 and arbor 244 from turning when the motor 210 is not powered on.

Flush Handle Details

Referring particularly to FIGS. 1-3C and 6, the flush handle 102 is intended to serve additional functions. Its primary role to operate the toilet flush valve is unchanged, but added to it are two sensor switches 104, 105. An electrical cable 258 for the sensors 104, 105 has a plug 260 that plugs into a sealed receptacle 262 in the blower housing 202 and connects to a control circuit 264. This small sized, flexible sensor cable 258 leads up the back side of the toilet water tank 106, passes under the lid, and enters the back of the special flush handle 102. A notch or some other clearance for the sensor cable 258 should be formed into the top edge of the tank 106. The flush handle 102 is to be a completely sealed device, especially where the sensor cable 258 enters it from the inside of the water storage tank 106.

Sealed within the flush handle 102 is a proximity detector 104 (e.g., infrared or ultrasonic) and a flush detector (e.g., a flush handle position sensor) 105. (This combination is preferred, although FIG. 2 shows a less sophisticated embodiment wherein the proximity detector 104 is mounted on the front of the toilet tank 106, and the flush detector 105 is mounted inside the tank 106.) The proximity detector 104 looks for (detects) the presence (proximity) of an occupant on the toilet seat 108 and if so, will signal the start of the blower unit 200. Since the handle 102 is to one side of the water tank 106 the proximity sensor 104 needs to view the area of the occupant at an angle from the flush handle to the occupant. The position of the flush handle 102 to the side also offers a clear view around the toilet seat 108 when it is in a raised position. For these reasons the proximity detector 104 is lensed and angled suitably to have an angled viewing range aimed at an occupant on the toilet seat 108 with a sensing distance of about one foot (12 inches) more or less.

The flush handle position sensor switch 105 will indicate when the toilet is flushed and signal the blower unit 200 to stop. An exemplary design for the flush sensor 105 would be to use a tilt sensor such as a hall effect transistor 140 activated by a steel ball 142 rolling in a tubular cage 144 wherein the cage 142 is tilted down away from the transistor 140 when the flush handle 102 is in its normal level position, and is tilted down toward the transistor 140 when the flush handle 102 is pushed down to initiate flushing. An alternative to the caged ball 142 would be to use a swinging or hinged steel weight performing the same function as the steel ball 142. The flush sensor 105 signals the control circuit 264 to turn the blower unit 200 off. Other types of switches could be used for this function. A fully mechanical design could be used but would be bulky and less reliable. A mercury tilt switch would be an alternative but raises concerns about the chemical hazards of mercury should the device be broken open or recycled.

Blower Unit Details

The blower unit housing 202 is preferably made of a molded plastic resin, one meeting the mechanical requirements of the device. It must have good moisture characteristics and resistance to common cleaning agents. The appearance is also important. A finely textured surface is desired along with the ability to be colored to match the various bathroom fixture colors.

Given the possibility of water entering the exhaust duct 116 and thus the blower unit 200, certain precautions must be taken in the design and construction of the toilet ventilation system 10. All air passages will be such that water entering the ventilation system 10 will drain by gravity when the blower unit 200 is attached in its normal operating position. Also any parts extending into the airway 230, for example the shaft 242 between the motor 210 and the impeller 212, are sealed. These seals must be resistant to mechanical wear due to the motion of the shaft and have chemical resistance to water and cleaning agents. The entire ventilation duct system (116, 230, 122) must maintain a sealed condition from the room as well as the electrical/motor compartment 231 of the blower unit 200. The sealed motor/electrical compartment 231 of the housing 202 contains the motor 210, a valve solenoid 214 (possibly combined with the motor 210), and the control circuit (electronics) 264, therefore the compartment 231 is also externally sealed sufficiently to resist cleaning solutions as well as the possibility of being splashed with water or urine. Special consideration is to be given to the entry into the housing 202 of a 120 volt AC electrical supply cord 204, and of a plug connector 260 used for the sensor cable 258. These must be liquid tight or at least moisture resistant. In the event the shaft seals 243 should fail and allow moisture to enter the motor/electrical compartment 231, and to allow normal breathing of this area, a small drain hole will be located at the lowest point of the housing. A diameter of about 3/32 inch and covered on the inside of the housing with a synthetic fiber pad to act as a dust filter will accomplish this. The adjustment screw 228 on the mounting fork 226 is also sealed with a sleeve or boot or gasket as shown for example in FIG. 4.

The possibility of heat buildup from the electrical equipment inside the sealed compartment 231 should not be a problem under normal circumstances due to the intermittent nature of use. If it is determined that heat is a problem, the plastic housing 202 may have to include heat transferring panels. These could be of anodized aluminum with internal and/or external fins.

The blower impeller 212 and related motor 210 will be of a design that delivers about 20 to 30 cubic feet of air per minute, free air rating. It will be at a reduced flow rate in actual use due to the drag imposed by the ductwork. Given this situation and the possibility of slight air pressure in the sewer system 910 with its outside vent 904, the blower design should be one with good displacement characteristics, one that is good at working against a backpressure. The impeller 212 is made from a material (e.g., plastic resin) that is suitable for use in a wet environment and resistant to the common chemicals used in toilet bowl cleaning.

The blower motor 210 is a shaded pole, impedance protected design, of sufficient power for the air impeller 212 and robust enough to withstand a short period of time in a stalled or near stalled rotor state. The coil on the motor 210 should be dip coated or encapsulated for moisture resistance. A rotor shaft 242 of stainless steel with permanently lubricated bearings are preferred.

A possible variation in design is to join the motor 210 and actuator (solenoid) 214 into one device, thereby simplifying the system. By modifying the basic shaded pole motor frame so that part of the frame, which is actually a magnetic circuit, is made of a movable section, it will act as a solenoid. When energized the solenoid plunger would pull in and complete the magnetic circuit so that the motor will run. The motion of the plunger will be used to operate the backflow valve 215, through mechanical linkage. This design eliminates the need for a separate solenoid coil 214 and electric circuitry for it.

The sealed motor/electrical compartment 231 of the housing 202 is made to hold the motor 210 in such a way as to not adversely affect airflow necessary for its cooling. A small fan blade or impeller (not shown) in the compartment 231 as part of the motor 210 aids in heat dissipation, as this is a sealed compartment 231. Where the motor shaft 242 enters the airway 230, the housing 202 retains a high quality rotary shaft sealed bearing 243 to rotationally support the impeller 212 while excluding moisture from the bearing 243 and from leaking out from the airway 230 into the sealed motor/electrical compartment 231.

Control Circuit Details

Inside the sealed motor/electrical compartment 231, the blower unit 200 will contain a control circuit 264 (e.g., a printed circuit board), which will control all of the electrical and logic functions of the ventilation system 10. From the outside of the housing 202 a vertical row of small indicator lights 208 (e.g., light emitting diodes—LEDs) can be viewed through holes in the housing 202 that are covered with part of a product label 206. For example, the indicator lights 208 will display "green" for power supplied, "red" for faults, and perhaps other status indications.

It will be recommended that power be supplied from a GFCI protected line. AC power of 120 volts will power the device, brought in on a 3-conductor cord 204 fitted with a standard NEMA 5-15 plug. Ground fault protection is preferably designed into the control circuit 264 as well. The voltage used for the sensor switches must be low (e.g., 12 volts DC for safety). Also, isolation from the AC power source and grounding must be considered.

A number of logical operations need to be performed. An infrared or other suitable proximity sensor 104 indicating, "toilet occupied" turns the blower unit 200 on, whereupon the backflow valve actuator 214 is energized to open the backflow valve 215, and to close a set of (relay) contacts, which in turn energize the blower motor 210. If the combined motor and solenoid are used this operation is more direct to just energizing the one coil that drives both functions. Likewise, if the second embodiment of backflow valve 215' is used, then everything is accomplished by simply turning on the motor 210. The blower motor 210 runs until a signal is received from the flush detection sensor 105, indicating the toilet has been flushed. This immediately turns the motor 210 (and solenoid 214 if present) off, thereby closing the backflow valve 215, 215' so that the toilet 100 can flush normally without concern about sewage backing up into the ventilation system 10. Also, if the person leaves the occupancy sensor 104 range (leaves the toilet 100), then the blower unit 200 turns off in the same way. Some delay timing can be used to keep the system 10 from turning on and off rapidly.

For improved safety and functionality, two other functions are performed. A temperature sensor on the circuit board 264 checks for overheating in the housing 202 and shuts the system 10 down if it occurs. This condition initiates display of a red fault light (LED) 208 if present, and may automatically reset or require an operator to perform a power off to reset the system. Also, a run timer may be used to shut the system down after 10 to 15 minutes, as it is doubtful longer running time will do any good. After timing out, the controller 264 will reset itself to the normal off state ready to start again upon receiving a signal from the occupancy sensor 104.

Product Label

A high quality multifunction label 206 will be adhered to the outward face of the housing 202. A flat area to contain the label 206 is molded into the face of the housing 202, as are holes for the LEDs 208. In the locations of the LEDs 208, the label 206 will have clear or translucent windows. The product label 206 contains all or part of the following: copyrighted and registered product name; patent notification; manufacture's name, address, and phone number; safety warnings; model and serial numbers; and legends for the LED status indicator(s) 208. Alternatively, the label 206 could simply be printed on, or molded into the face of the housing 202.

Servicing and the Service Cover

The blower unit 200 can be easily removed (e.g., for servicing) by unplugging the AC power cord 204 from the wall outlet, unplugging the sensor cable 258 from the housing 202, and loosening the forked mounting finger tensioning screw 228. The blower unit 200 can then be packaged and shipped for service or replaced with a new unit 200. After removal of the blower unit 200 a service cover 300 is installed in its place to close off the two duct openings 120, 128, thereby allowing normal operation of the ventilated toilet 100 without an operational toilet ventilation system 10.

The service cover 300 is a one-piece molded plastic panel made with fingers 304, 306 that allow it to snap on to and hold itself in position over the two duct openings 120, 128 on the toilet base 109. The fingers 304, 306 are formed so that they give some spring action as they engage the duct openings 120, 128 and allow for dimensional variations. The locations of these fingers 304, 306 are similar to those of the fingers 224, 226 for the blower unit 200 mounting. The oblong panel of the cover 300 is ribbed (e.g., circumferential rib 308) for stiffness to provide even pressure over a closed cell foam rubber gasket 310. This gasket material needs to be soft enough to compress easily and seal the space between the cover and the toilet bowl.

Installing or removing the flush handle 102 with its sensors 104, 105 is similar to any other common flush handle and requiring only simple mechanical skills and tools. The only added considerations are threading the electrical cable and connector plug through some hardware and down the backside of the toilet tank. (Hardware to thread through includes all or part of the flush valve lift arm, retaining washer, and retaining nut.) There may be a cable support device at the lower edge of the toilet tank to clip into. The connector plug 260 fits a socket 262 on the blower unit 200.

Although the invention has been illustrated and described in detail in the drawings and foregoing description, the same is to be considered as illustrative and not restrictive in character—it being understood that only preferred embodiments have been shown and described, and that all changes and modifications that come within the spirit of the invention are desired to be protected. Undoubtedly, many other "variations" on the "themes" set forth hereinabove will occur to one having ordinary skill in the art to which the present invention most nearly pertains, and such variations are intended to be within the scope of the invention, as disclosed herein.

What is claimed is:

1. A ventilated toilet for exhausting fumes from a bowl area of the toilet to a sewage stack vent into which a toilet drain duct empties the ventilated toilet through a water trap, the ventilated toilet comprising:

a built-in vent exhaust duct extending upward from a bowl vent hole and then downward to an exhaust duct outlet hole that exits through a mounting surface provided on the exterior of the ventilated toilet;

a built-in vent exit duct extending downward from an exit duct opening in the mounting surface to the toilet drain duct;

a blower unit removably attached to the mounting surface of the ventilated toilet, and communicating with the exhaust duct outlet hole and the exit duct opening, wherein the blower unit comprises: a housing containing a motor/electrical compartment and a separate sealed airway extending from a blower intake hole downward to a blower output hole; a fan impeller in the airway; a motor mounted in the motor/electrical compartment, but sealingly connected to the fan impeller; a backflow shut-off valve comprising a stopper in the airway and an actuator linked for moving the stopper; and a control circuit; and a blower unit removable attachment apparatus comprising: a lower mounting finger extending outward from the blower output hole and shaped and sized for hooking into the exit duct opening, thereby aligning the blower output hole with the exit duct opening; an upper mounting finger extending outward from the blower intake hole and shaped and sized for hooking into the exhaust duct outlet hole, thereby aligning the blower intake hole with the exhaust duct outlet hole; and an adjuster that adjusts the position of one of the lower mounting finger and the upper mounting finger, thereby enabling removable attachment of the blower unit to the mounting surface of the ventilated toilet.

2. The ventilated toilet of claim 1, further comprising:

a flush detecting sensor electrically connected to the control circuit.

3. The ventilated toilet of claim 1, further comprising:

a proximity sensor electrically connected to the control circuit.

4. The ventilated toilet of claim 3, wherein:

the proximity sensor is built-in to a flush handle of the ventilated toilet.

5. The ventilated toilet of claim 4, further comprising:

a flush detecting sensor electrically connected to the control circuit wherein the flush detecting sensor is built-in to the flush handle; and the proximity sensor and the flush detecting sensor are connected to the control circuit by a sensor cable that is detachably connected to the blower unit.

6. The ventilated toilet of claim 1, wherein:

the mounting surface is a side surface of a base of the ventilated toilet.

7. The ventilated toilet of claim 1, wherein:

the exhaust duct outlet hole exits through the mounting surface at a downward angle;

the exit duct opening is below the exhaust duct outlet hole and enters through the mounting surface at a downward angle;

the lower mounting finger of the blower unit is downward and outward hooking for hooking over the bottom of the exit duct opening; and the upper mounting finger of the blower unit hooks upward and outward for adjustably hooking over the top of the exhaust duct outlet hole, such that adjusting the upper mounting finger upward, removably draws the blower unit against the mounting surface.

8. The ventilated toilet of claim 1, further comprising:

a flat portion of the mounting surface around the exhaust duct outlet hole and the exit duct opening; and a sealing gasket on the flat portion of the mounting surface.

9. The ventilated toilet of claim 1, further comprising:

a service cover shaped to sealingly cover the exhaust duct outlet hole and the exit duct opening in place of the blower unit when it is removed.

10. The ventilated toilet of claim 1, wherein the backflow shutoff valve actuator further comprises an electric solenoid.

* * * * *